US006584768B1

(12) United States Patent
Hecker et al.

(10) Patent No.: US 6,584,768 B1
(45) Date of Patent: Jul. 1, 2003

(54) VEHICLE EXHAUST FILTRATION SYSTEM AND METHOD

(75) Inventors: Michael Hecker; Adrian Corbett, both of San Diego, CA (US)

(73) Assignee: The Majestic Companies, Ltd., San Diego, CA (US)

( * ) Notice: Subject to any disclaimer, the term of this patent is extended or adjusted under 35 U.S.C. 154(b) by 78 days.

(21) Appl. No.: 09/714,741

(22) Filed: Nov. 16, 2000

(51) Int. Cl.[7] ..... F01N 3/00

(52) U.S. Cl. ..... 60/297; 60/295; 60/299; 60/311; 55/318; 55/350.1; 55/359; 55/385.3

(58) Field of Search ..... 60/311, 295, 297, 60/299, 303, 286; 55/318, 350.1, 359, 385.3, DIG. 3

(56) References Cited

U.S. PATENT DOCUMENTS 4,535,588 A * 8/1985 Sato et al. ..... 60/286
4,538,411 A * 9/1985 Wade et al. ..... 60/274
4,706,454 A * 11/1987 Smith, Jr. ..... 60/274
4,887,427 A * 12/1989 Shinzawa et al. ..... 60/286
4,934,142 A * 6/1990 Hayashi et al. ..... 60/297
5,457,945 A * 10/1995 Adiletta ..... 60/311
5,716,586 A * 2/1998 Taniguchi ..... 422/173
5,822,977 A * 10/1998 Fukuda et al. ..... 60/274
5,853,437 A * 12/1998 Peter et al. ..... 55/282.3

* cited by examiner

*Primary Examiner*—Thomas Denion
*Assistant Examiner*—Binh Tran
(74) *Attorney, Agent, or Firm*—Steins & Associates, P.C.

(57) ABSTRACT

A Vehicle Exhaust Filtration System and Method is disclosed. Also disclosed is a system and method that reduces the airborne contaminants leaving the exhaust pipe of any internal combustion engine to which the system is attached. Furthermore, the method and system involves the use of recyclable cartridges that can be exchanged on a planned maintenance program. Still further, the disclosed system and method prohibits engines failing to have acceptably clean filter/converters from being started. It is another aspect of the present invention that the method and system provide an alert to the user, and potentially to external individuals, that the change out deadline is approaching.

20 Claims, 10 Drawing Sheets

VEHICLE EXHAUST FILTRATION SYSTEM AND METHOD

BACKGROUND OF THE INVENTION

1. Field of the Invention

This invention relates generally to vehicle exhaust systems, and more specifically, to improve a Vehicle Exhaust Filtration System and Method.

2. Description of Related Art

In the world today there are thirty million new vehicles produced each year. Virtually all the major cities around the world are being choked by vehicle pollution, and the entire world is suffering more and more as each year passes. In the last ten to fifteen years, the international automotive industry has tried and failed to produce a practical vehicles of either "zero emissions" or "low emissions" types, to no avail. It is generally stated that there is enough fossil fuel left, tapped and untapped, to run vehicles for another fifty-years. As such, it is imperative that a solution is arrived at for this growing problem.

If we turn to FIG. 1, we can see that for a Conventional Tractor Truck (10), the exhaust is passed from the engine to the environment after first passing through a simple Muffler (14) and Exhaust Pipe (12). The muffler (14) may include some filtration capability, or even possibly some method for burning, purifying, or otherwise removing unburned fuel from the effluent stream, however, there is no widely-used system that has both filtration and purification. As a result, these Conventional Tractor Trucks (10) are a great source of the pollutants emitted into the atmosphere; it should be noted that all internal combustion engines contribute to this problem, but particularly on- and off-road-use diesel-powered vehicles.

If we now turn to FIG. 2, we can see that in this simplified system, the Engine (16) discharges exhaust product to an Exhaust Manifold (18), which is then piped to Muffler (14), then out to the atmosphere through the Exhaust pipe (12). What is needed is some method and system to adapt to prior art Engine (16) and Exhaust Manifold (18), such that the effluent contains fewer gaseous and particulate contaminates, in order to alleviate the environmental damage being caused by trucks, cars and other internal combustion vehicles.

SUMMARY OF THE INVENTION

In light of the aforementioned problems associated with the prior devices and systems, it is an object of the present invention to provide an improved Vehicle Exhaust Filtration System and Method. The preferred system and method should reduce the airborne contaminants leaving the exhaust pipe of any internal combustion engine to which it is attached. It is a further object that the method and system involve the use of recyclable cartridges that can be exchanged on a planned maintenance program. It is yet another object that the system and method prohibit engines failing to have acceptably clean filter/converters from being started. It is another object that the method and system of the present invention provide an alert to the user, and potentially to external individuals, that the change out deadline is approaching.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a Vehicle Exhaust Filtration System and Method.

Figure 1:
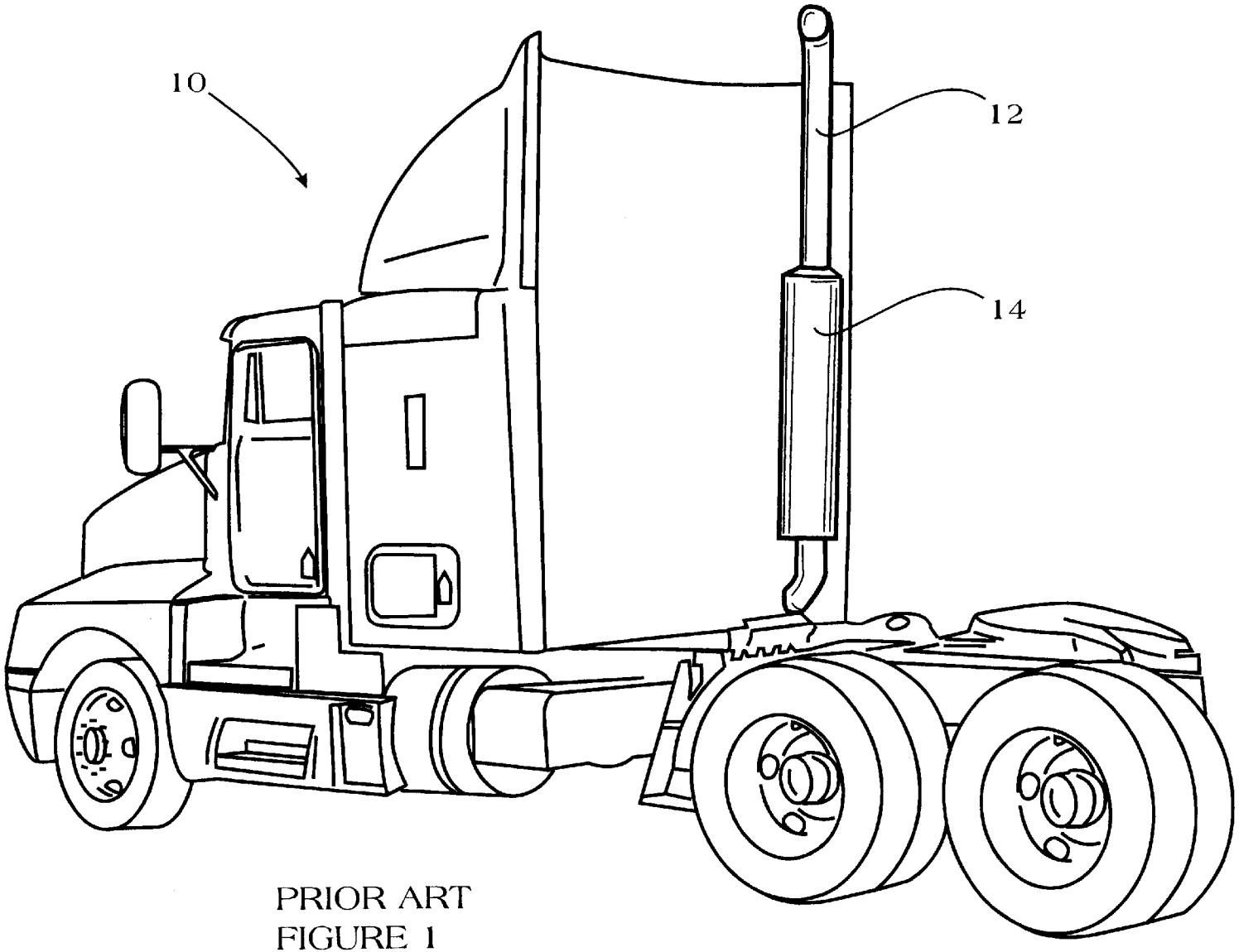
PRIOR ART FIGURE 1
FIG. 1 is a perspective view of a conventional tractor truck.
Figure 2:
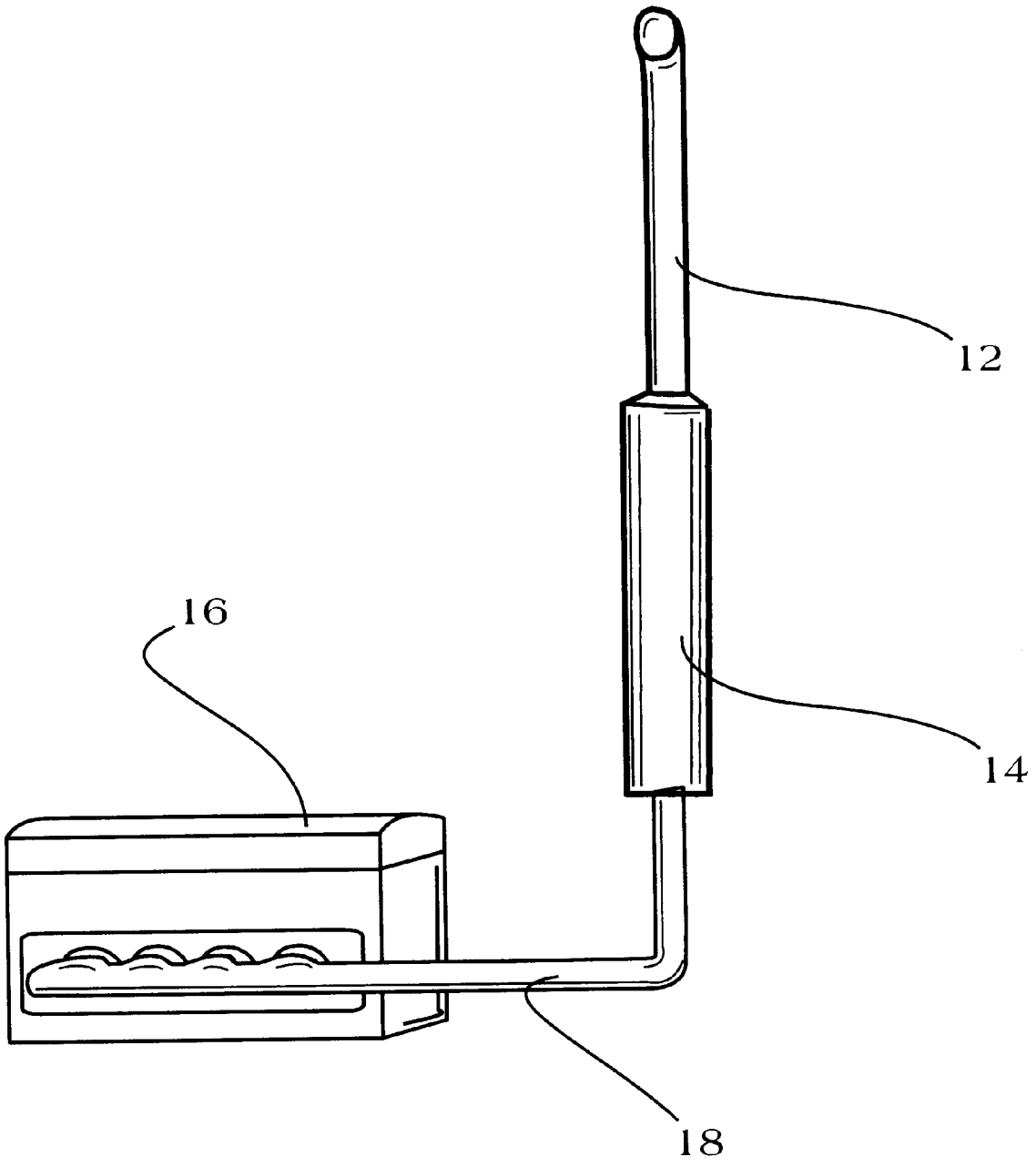
PRIOR ART FIGURE 2
FIG. 2 depicts a conventional engine and an exhaust system of the tractor truck of Figure.
Figure 3:
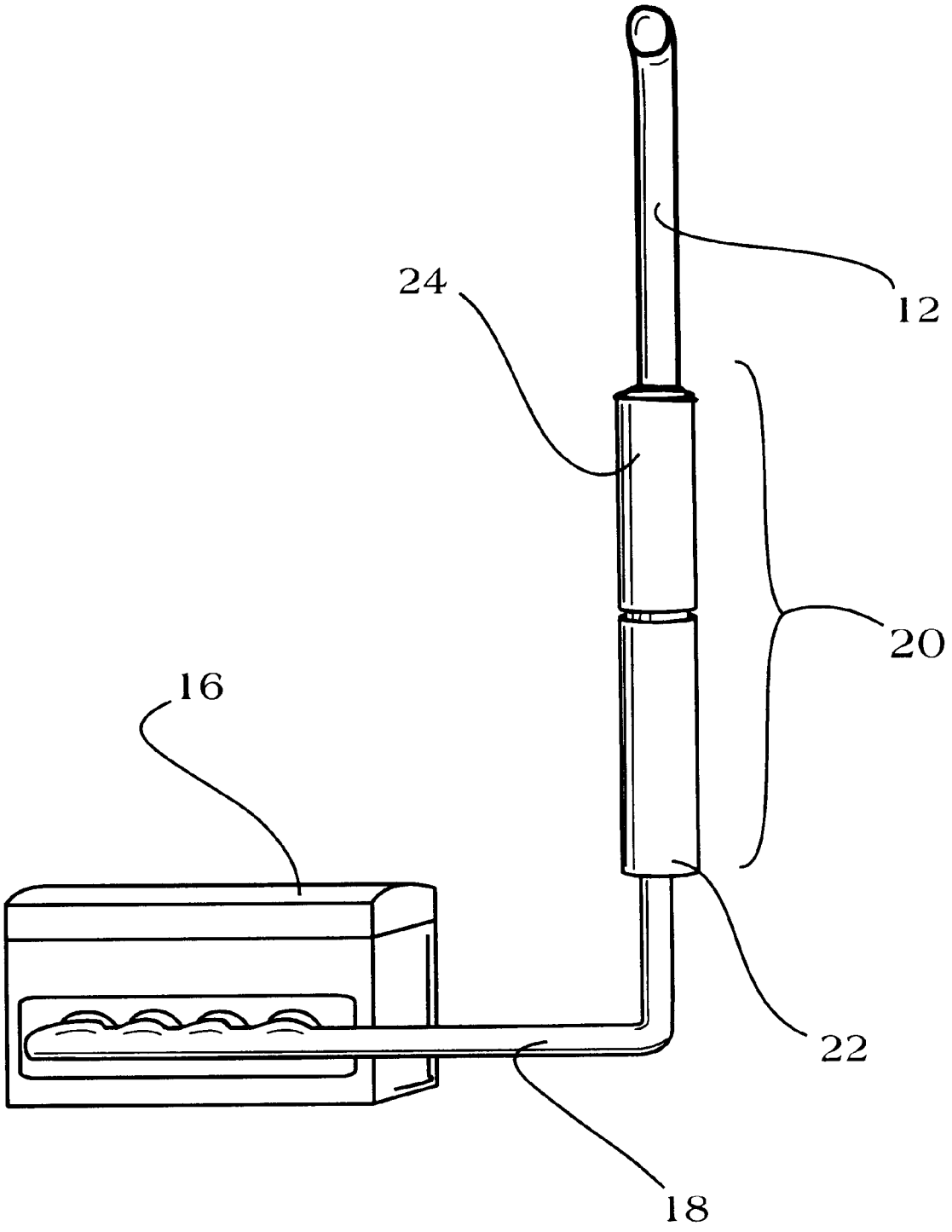
FIG. 3 depicts the exhaust system of FIG. 1 as improved by the filter/converter assembly of the present invention.

The present invention can best be understood by initial consideration of FIG. 3. FIG. 3 depicts the exhaust system of FIG. 1 as improved by the filter/converter assembly of the present invention. As can be seen here, it is a theoretically simple matter of removing the conventional muffler and replacing it with the Filter/Converter Assembly (20) of the present invention. While only depicted schematically here, it should be understood that within the Assembly (20) is contained a particulate Filter (22) and a Converter (24). It is believed that the ability to manufacture both the particulate Filter (22) and Gas Converter (24) (or gas purification means) exists in the current state of the art. What is new however, is the combination of the two in a single Assembly (20) with the aspects discussed below in connection with FIGS. 5 through 10.

Figure 4:
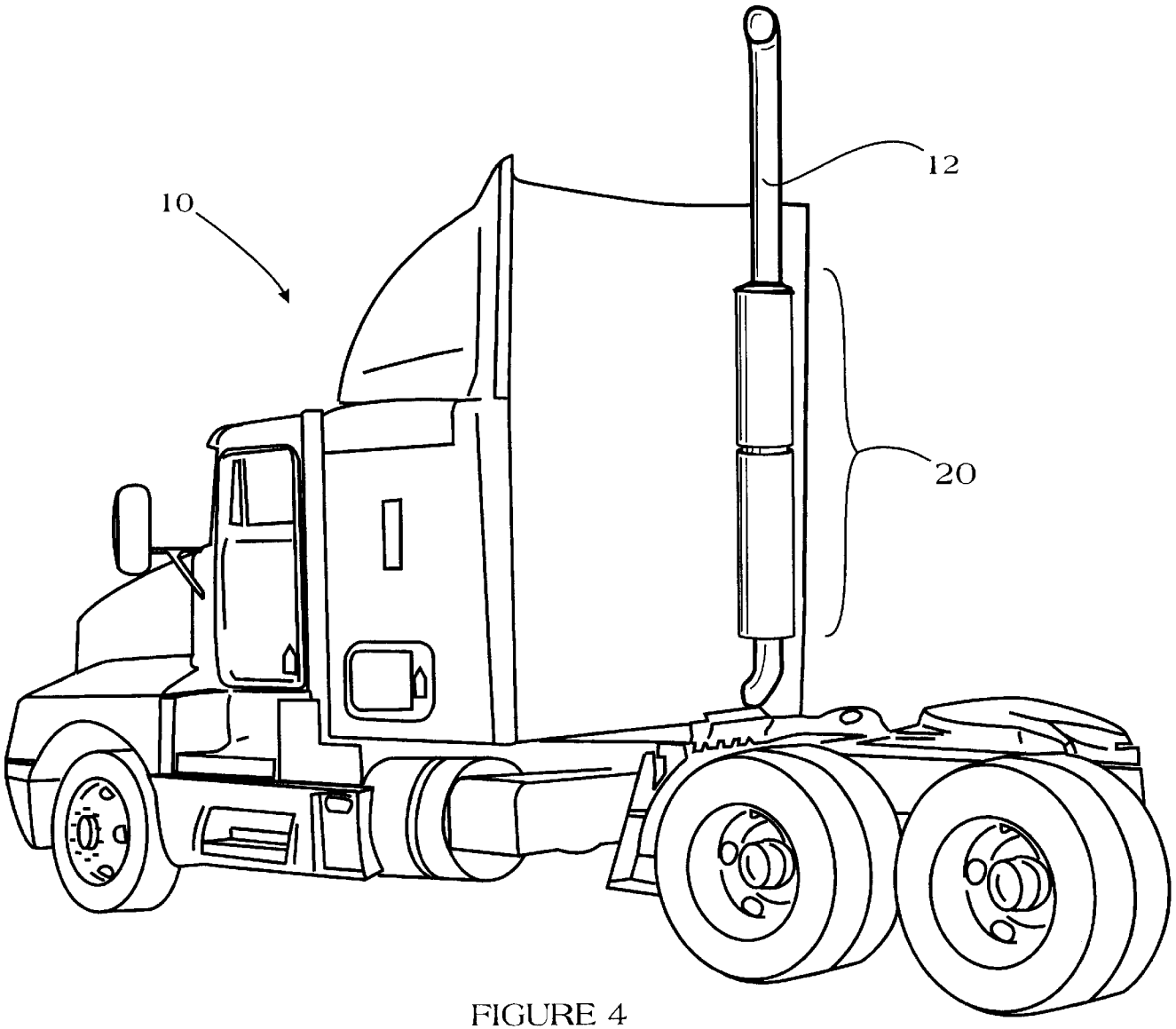
FIGS. 4 are a perspective view of the assembly of FIG. 3 as it might be installed in the conventional truck of FIG. 1.

If we now turn to FIG. 4, we can see that the Conventional Tractor Truck (10) will not require major external modifications in order to install Filter/Converter Assembly (20) of the present invention. FIG. 4 is a perspective view of the assembly of FIG. 3 as it might be installed in the conventional truck of FIG. 1. The reader should understand that this is only one example of the type of vehicle where the present invention might be installed. It will certainly be desirable to provide a very similar Filter/Converter Assembly (20) for use in virtually any passenger vehicle as well. In such a case, the Filter/Converter Assembly (20) would most likely be located in an area of the vehicle body that is safe for this vehicle application, but is also easy to access when changing out cartridges.

Figure 5:
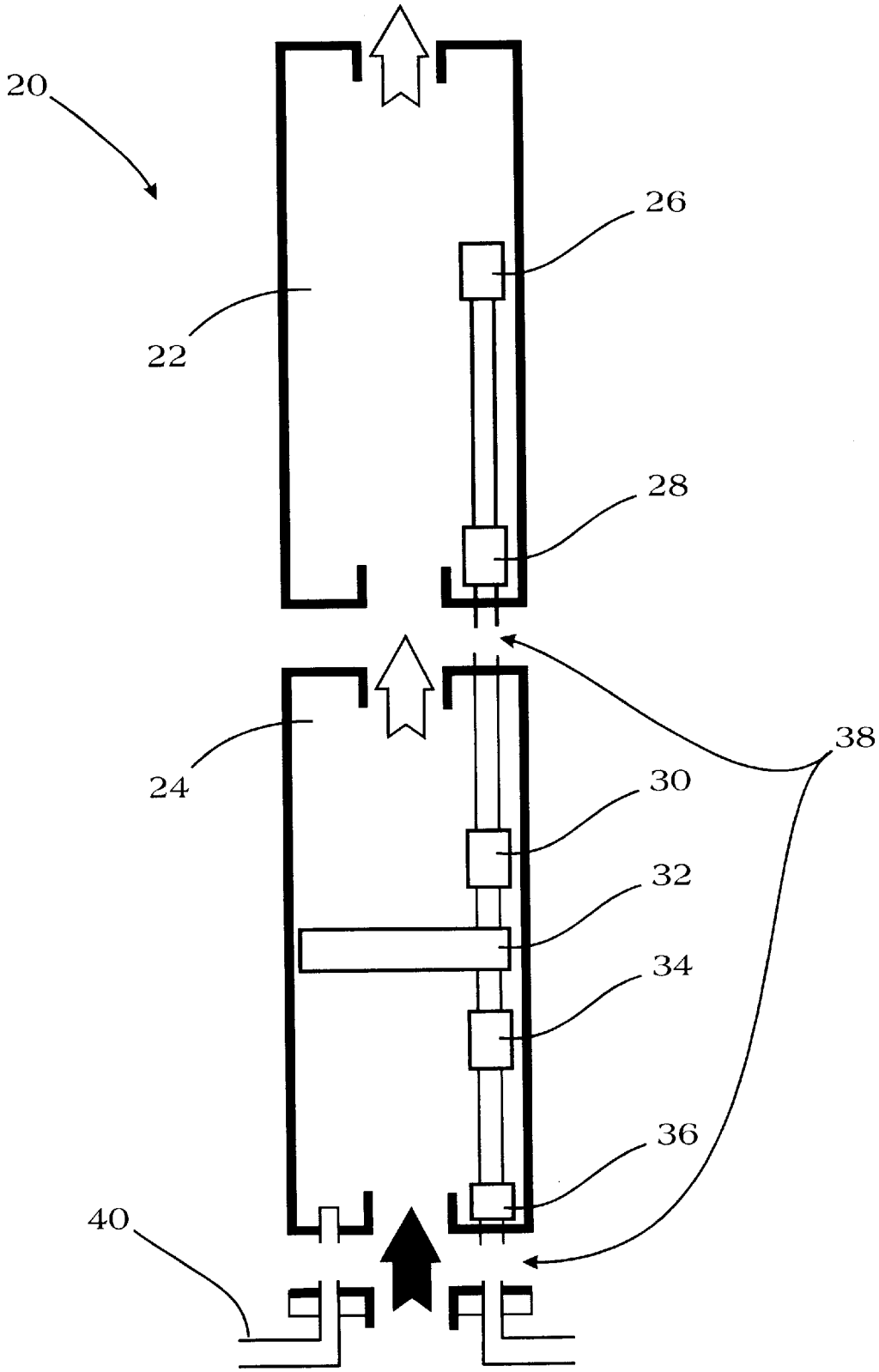
FIG. 5 is a cutaway depiction of the preferred embodiment of the filter/converter assembly of the present invention.

If we now turn to FIG. 5, we can examine the Filter/Converter Assembly (20) of the description in more detail. FIG. 5 is a cutaway depiction of the preferred embodiment of the Filter/Converter (20) assembly of the present invention. In this depiction, the Filter/Converter Assembly (20) includes a Particulate Filter (22) attached down-stream of the Gas Converter (24). It should be understood that the locations of the Filter (22) and the Converter (24) might be reversed such that Filter (22) is upstream of Converter (24), depending upon the application.

The Particulate Filter (22) might further include a Clogging Sensor (26) for detecting when clogging of the Filter (22) is occurring, to the extent such that there begins to be an unacceptable pressure drop across the Cartridge (22). Furthermore, the Filter (22) may include a Control Unit (28) for communicating between the Pressure Unit (26) and the other vehicle emissions systems that are described below in connection with FIG. 9. The Gas Converter (24) will preferably include a Purity Sensor (30) for determining when the Converter (24) begins to fail at its purification task. At that time, Purity Sensor (30) would provide a signal to the control system (See FIG. 9) notifying the system that a problem is occurring.

In many cases, the Gas Converter (24) will require a Heater (32) in order to bring the Converter (24) into its operating condition (when the engine is first started cold). In other situations, the Heater (32) may not be necessary. The Converter (24) may further include a Clogging sensor (34), again, to detect when an unacceptable pressure drop occurs across the core of the Converter (24). Finally, a Control Unit (36) is provided to communicate between the components within the Converter and the rest of the system, the Electrical Connection (38). Since the Filter (22) and the Converter (24) are replaceable, the Electrical Connection (38) must be capable of being broken when the cartridges are removed, and then reestablished once new ones are being installed. It might be further necessary for the Assembly (20) to be provided with a Vacuum or Pressure Supply (40) in order to supplement the operation of the system. Again, it should be realized that the Filter (22) might be constructed from conventional materials or methods to provide a washable, durable and low backpressure filter cartridge. Similarly, the current embodiment Gas Converter (24) might be simply what is known as a catalytic converter on vehicles available today. The only difference here is that the Converter (24) is preferably cleanable or rejuvenateable such that dirty Converters (24) can be recycled for reuse.

Figure 6:
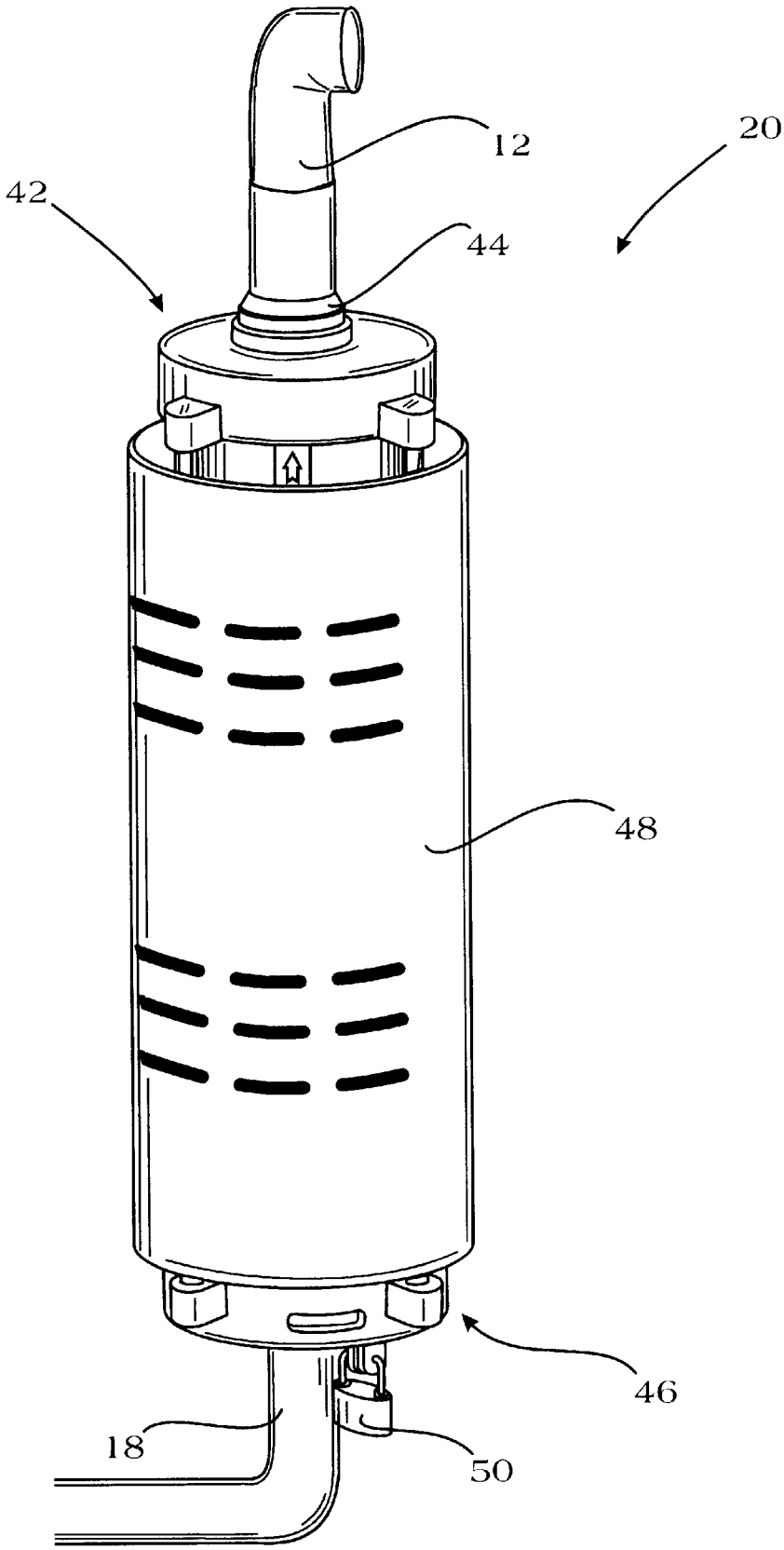
FIG. 6 is a perspective view of the assembly of FIG. 5.

Now turning to FIG. 6, we can explain the structure of the Filter/Converter assembly (20) of the present invention in further detail. FIG. 6 is a perspective view of the assembly of FIG. 5. We can explain in further detail in regards to the structure of the Filter/Converter Assembly (20) of the present invention in further detail. As we can see in FIG. 6, Assembly (20) is attached to the Exhaust Manifold (18) by a lower Hub Assembly (46). It attaches to the Exhaust Pipe (12) by an Adapter Segment (44) and an Upper Hub Assembly (42). In this preferred embodiment, an openable Heat Shield (48) is provided to protect against inadvertent burns or tampering. Since the Heat Shield (48) can be opened, it will preferably be provided with Locking Means (50), such as a conventional padlock as shown, to prevent the Heat Shield (48) from being opened by unauthorized individuals. This Locking Means (50,) in fact, may be accessible only by licensed individuals operating certified Converter and Filter recycling stations, in order to ensure that there is excellent control over the recycling process.

Figure 7:
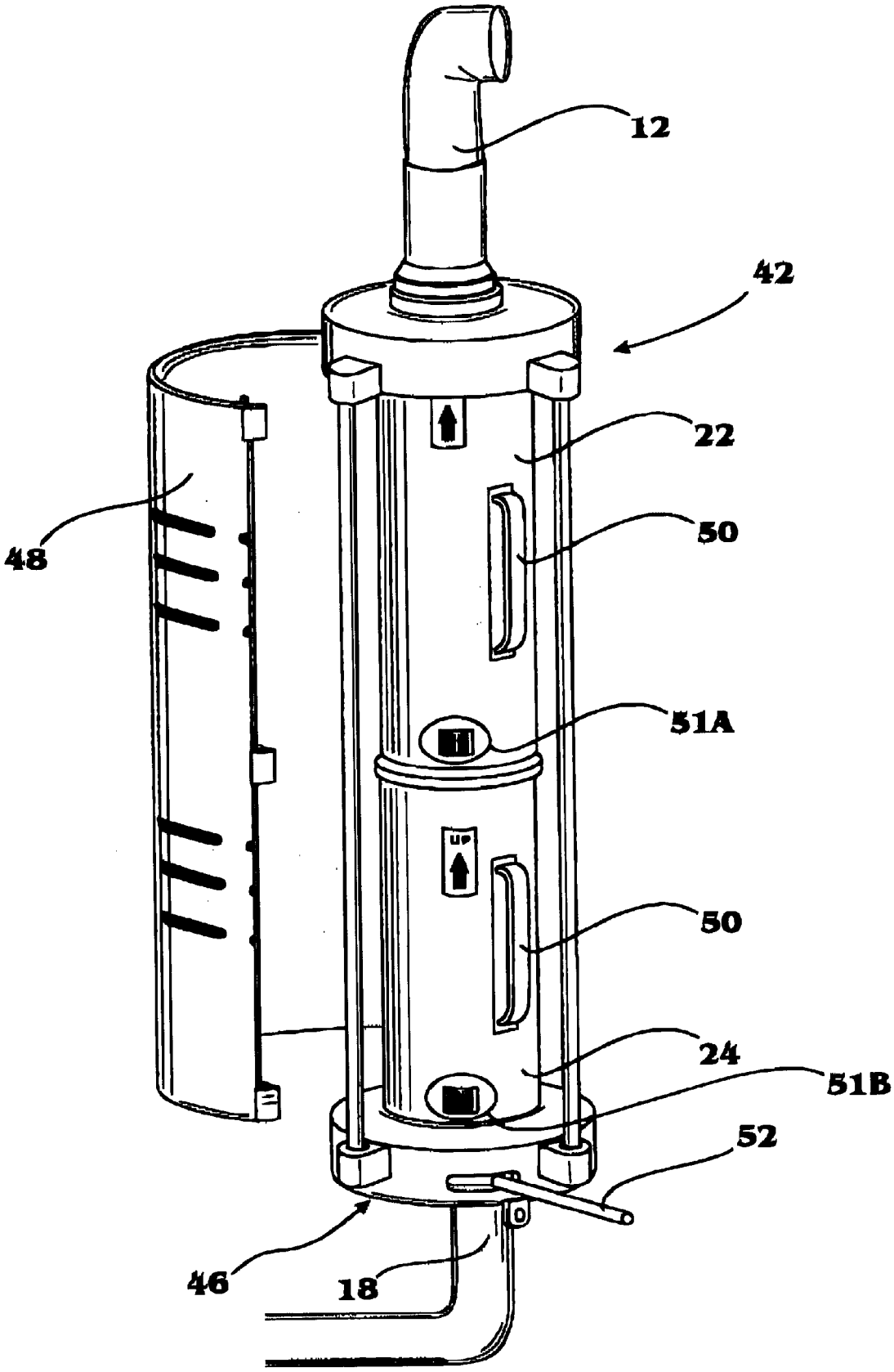
FIG. 7 is a perspective view of the assembly of FIGS. 5 and 6, showing the heat shield door open.

We now turn to FIG. 7, we can examine additional features of the System (20) of the present invention. FIG. 7 is a perspective view of the Assembly (20) of FIGS. 5 and 6, showing the Heat Shield Door Open (48). As it can be seen in FIG. 7, the Cartridges (22) and (24) are preferably each provided with Handle (50) to assist the user in their removal. When installed, it is simple matter of positioning the Removable Actuating Handle (52) to lock or unlock the Cartridges (22) and (24). The Actuating Handle (52), may be simply a bar or a rod already in use on a Conventional Tractor-Trailer Truck.

The two cartidges (22) and (24) are interconnected to one another by coupling means, such as a conventional "V"-clamp around beveled flanges provided on the mating ends of the two cartridges (22) and (24); the "V"-clamp is only one method for attaching the cartridges together—other conventional methods are also functionally acceptable.

Figure 8B:
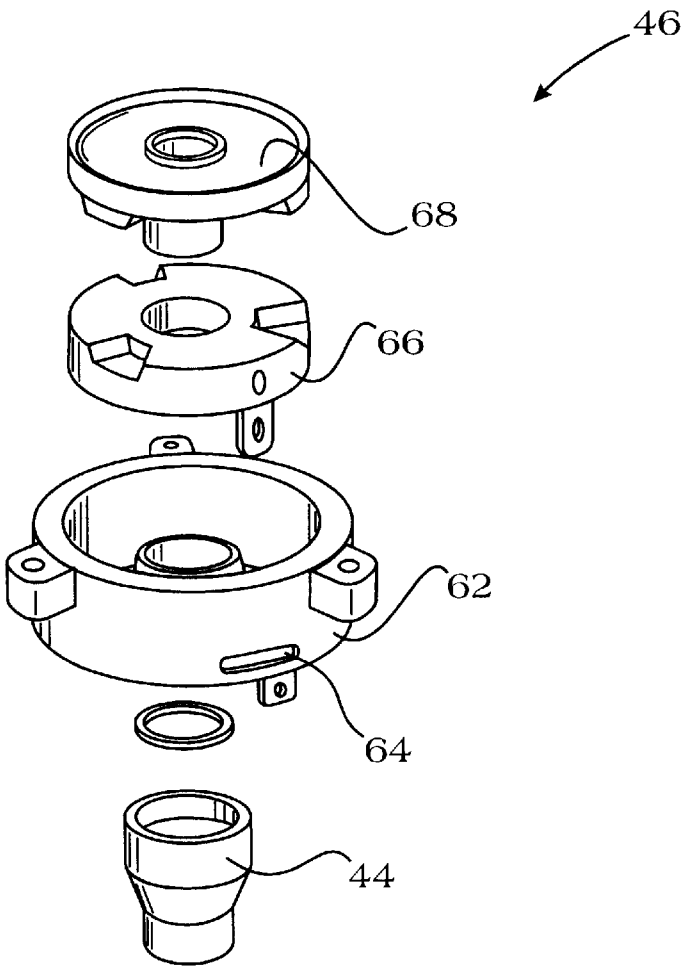
FIGS. 8A and 8B are exploded perspective views of the upper and lower hub assemblies, respectively.
Figure 8A:
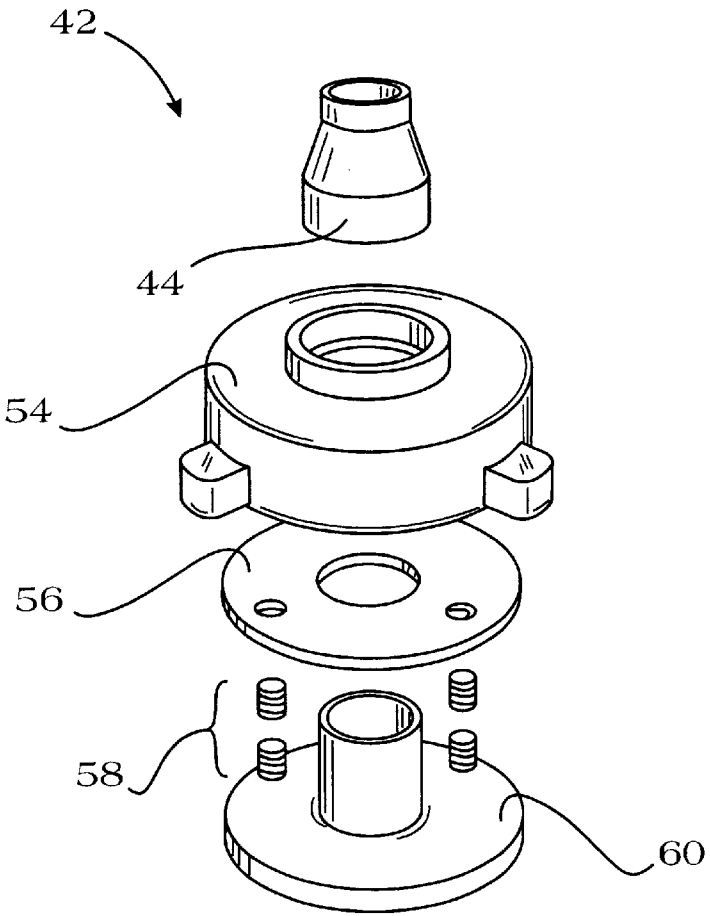

Now turning to FIGS. 8A and 8B, we can examine other details related to the Systems (20) of the present invention. FIGS. 8A and 8B are exploded perspective views of the Upper and Lower Hub Assemblies, (42) and (46), respectively. As we can see in FIG. 8A the Adapter Segment (44) of the Upper Hub Assembly (42) is located in the Upper Housing (54). The Upper Housing (54) is provided to be the main connection between the Exhaust Pipe and Assembly (20). As such, it is constructed from heat resistant materials to provide durability. Between the cartridges and the Upper Housing (54) is an Upper Centering Plate (60), which essentially serves to center the upper end of the stack of cartridges. Center Plate (60) is urged downwardly from the Housing (54) by a plurality of Biasing Means (58), such as the four springs shown in this example. A Plate (56) is also provided as a support for the Biasing Means (58) as they push down on the Upper Centering Plate (60).

Similarly, as shown in FIG. 8B, the Lower Hub Assembly (46) includes a Lower Housing (62), within which a Slot (64) is formed for the insertion of the Actuating Handle (See FIG. 7). The Actuating Handle (52) is configured to engage the Cam Plate (66) through the Slot (64), such that osillation of the Actuating Handle (52) will result in the rotation of the Cam Plate (66). It should be seen that the Lowering Centering Plate (68) cooperates with the rotation of the Cam Plate (66) to either force the Lower Centering Plate (68) up (thereby locking the cartridges in place), or permitting the Lower Centering Plate (68) to drop, thereby releasing the cartridge for removal.

Figure 9:
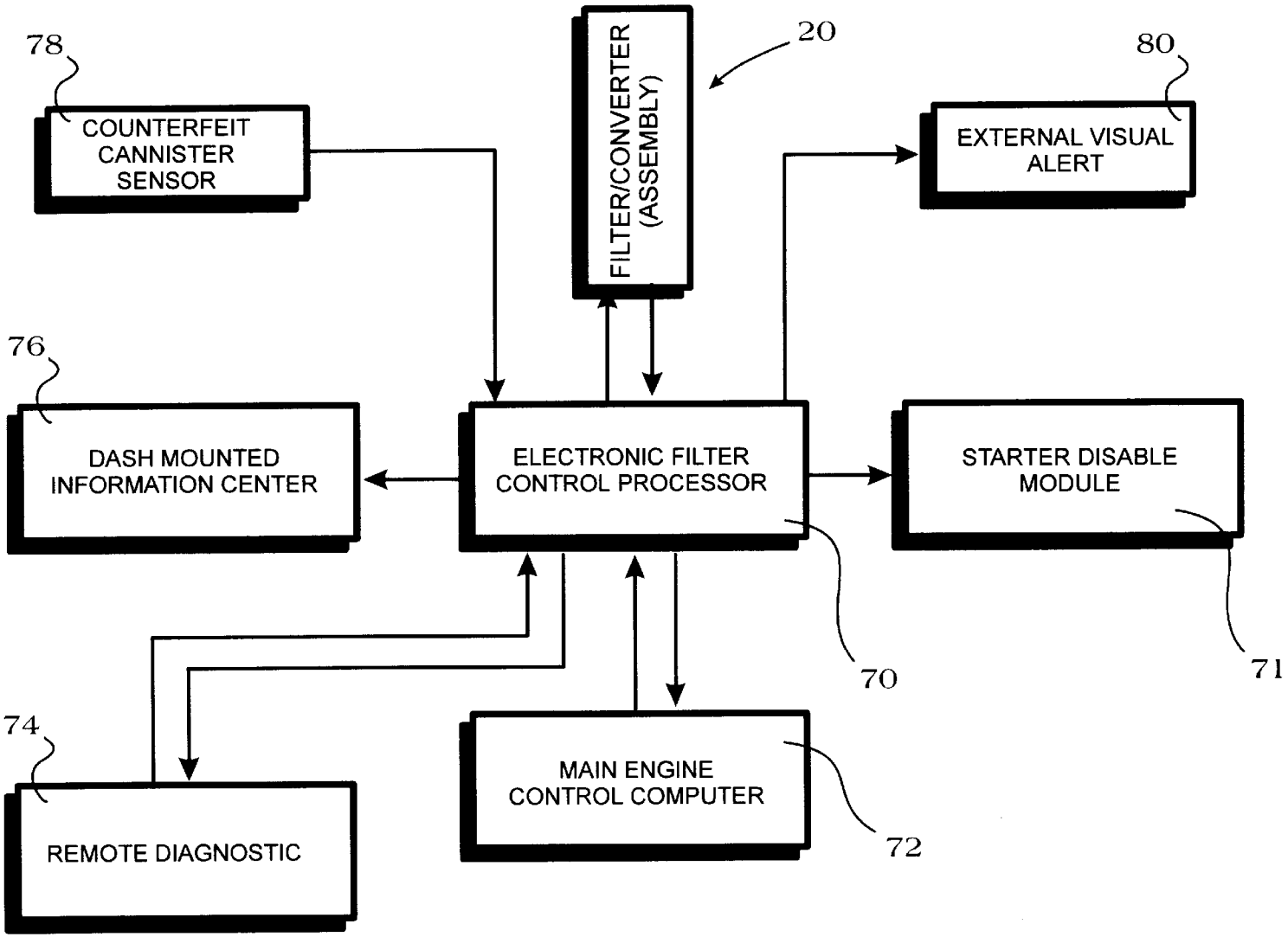
FIG. 9 depicts the preferred sensor and control configuration of the present invention.

Turning now to FIG. 9, we can review the Control and Monitoring Systems of the present invention. FIG. 9 depicts the preferred sensor and control configuration of the present invention. In this depiction, we can see that the Converter/Filter Assembly (20) is in communication with an Electronic Filter Control Processor (70). The Electronic Filter Control Processor (70) serves a variety of functions and monitors several different aspects of the system. In particular, the Starter Disable Module (71) is provided for the event when the Control Processor (70) is informed that either the Filter or the Converter is in an unacceptably degraded condition, in which case it might be desired that the vehicle starter systems be inhibited. The Filter Control Processor (70) further communicates with the Main Engine Control Computer (72) in order to maintain an independent analysis of the effluent stream such as is provided by inputs directly to the Main Engine Control Computer (72). The Filter Processor (70) further may be in communication with Remote Diagnostics (74), such as those described above in connection with FIG. 5. Furthermore, the Control Processor (70) might provide the user with a Dashboard-Mounted Information Center (76). This Dashboard-Mounted Information Center (76) provides the driver with a variety of information, including the last date of the rejuvenation, and the time remaining until the next rejuvenation is (or projected to be) required. A further aspect of this system is to include a sensor to detect whether or not a Counterfeit Canister (78) has been installed. This, again, is to prevent anyone from bypassing of the workings of the invention.

Figure 10:
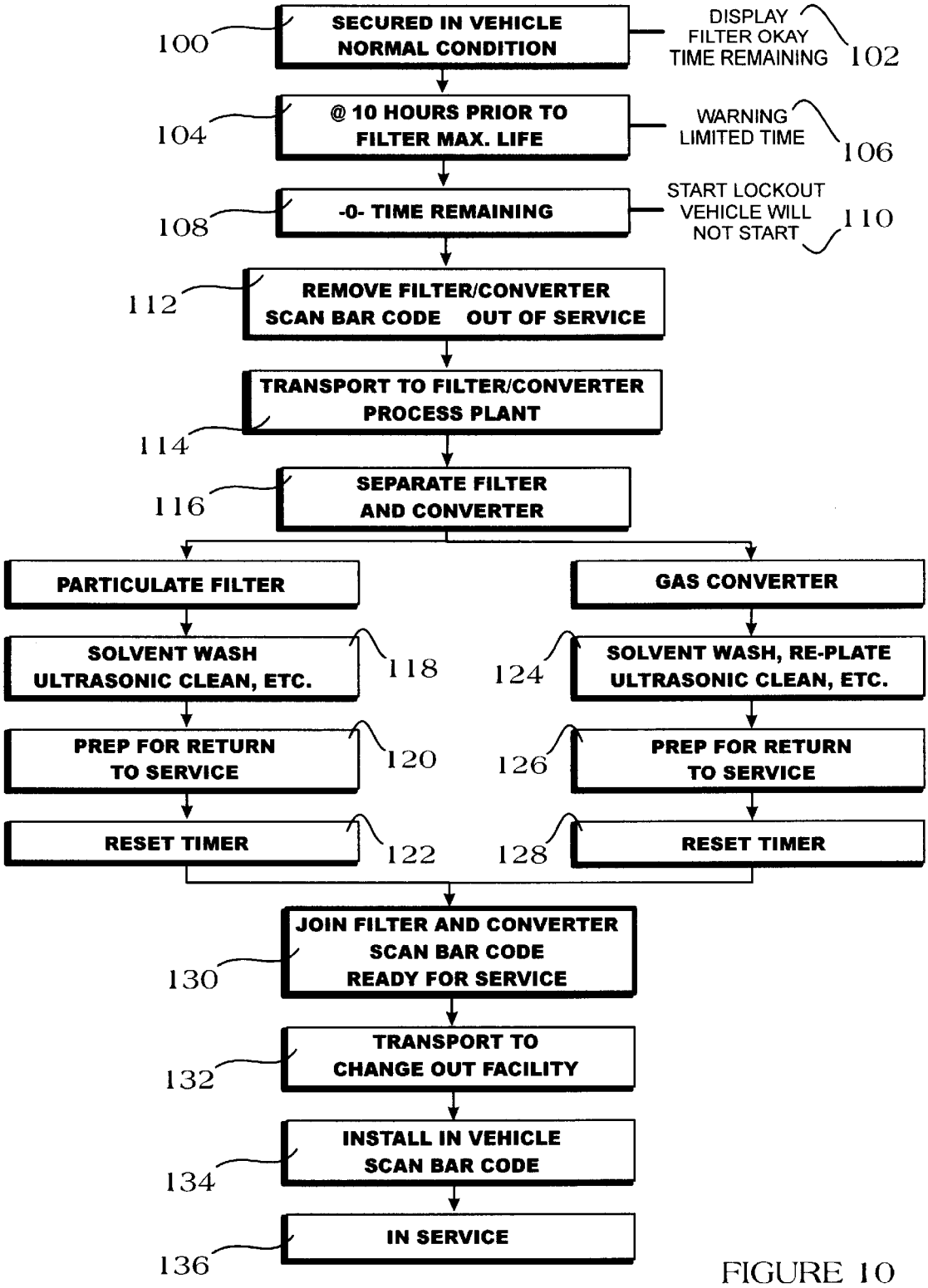
FIG. 10 depicts the preferred service and rejuvenation process of the system of the present invention.

Finally turning to FIG. 10, we can examine a preferred process for managing the rejuvenation of the Filter and/or the Gas Converter. FIG. 10 depicts the preferred service and a rejuvenation process of the system of the present invention. The preliminary step (100) begins with new filter and converter cartridges having installed within the system. On the Information Display, there will be a message (102) indicating that the filter is okay, along with the time remaining until the next change is required. Upon reaching ten hours prior (for example) to the filter or converter maximum life (104), the user will receive a warning that limited time remains until filter/converter changeout must be conducted (106). At zero time remaining (108), the Starter Disable Module (71) will preferably disable the motor and the user will receive a notice that the vehicle will not start (110). On or before this time, the Filter/Converter Combination must be removed (112). When this is done, it would be preferable that bar codes on each are scanned to indicate to the Master Canister Control System that these two canisters are out of service. The Master Canister Control System is projected to be a nation-wide (or even world-wide) system for the tracking of all canisters and vehicles involved in the system of the present invention, while the canisters are placed in service and then rejuvenated for later installation in another compatible vehicle.

Next, the filter and converter are transported to a processing plant (114) for rejuvenation. During this time, the filter and converter are separated (116) for independent processing and rejuvenation.

In the case of the Particulate Filter, it will preferably receive a Solvent Wash and/or Ultrasonic Clean (118) after which it will be prepared to be returned to service (120). This is done by drying, baking or by air-blowing. Furthermore, the internal timer mechanism will be reset (122). The Particulate Filter might be manufactured from a variety of materials, including, for example, ceramic fibers or ceramic spheres (in order that the necessary durability is provided).

In the case of the Gas Converter, it will receive either a wash, clean, or even a re-plating of consumable (e.g. catalytic) material (124), depending upon the technology of the Converter in use. The Converter will then be prepared for return for service (126) and its timer reset (128). At this time, the Converter and Filter pair will be rejoined (130), and the pair's bar code will be scanned, and the Master Canister Control System will be updated to indicate that the pair is ready for service. The Converter/Filter pair will be transported to a suitable change-out facility (132), where it will wait to be installed in a suitable vehicle (134). Once installed, the bar code will be scanned to indicate to the Master System that the pair is in service.

It should be understood that all filters and converters are intended to be rejuvenated and then re-used by another vehicle (with which that filter or converter is compatible). As such, it is expected that the change-out facilities will maintain a ready stock of rejuvenated (and new) canisters awaiting installation; this will prevent the need for a particular vehicle to await rejuvenation of their particular canisters.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A system for removing undesirable particulate and chemical contaminants from the exhaust stream of an internal combustion engine, said engine producing said exhaust stream from an exhaust manifold pipe, the system comprising:

a filter/purifier assembly attached to said exhaust manifold pipe, said assembly comprising:

a particle filtration means cartridge for filtering particulates out of said exhaust stream;

a gas converter means cartridge for removing chemical contaminants from said exhaust stream, said gas converter means aligned in series with said particle filtration means cartridge;

cartridge tracking indicia displayed on each said cartridge; and a master tracking system configured to cooperate with said cartridge tracking indicia to maintain status and history data for each said cartridge.

2. The system of claim 1, wherein said particle filtration means comprises a rejuvenatable filter cartridge and said gas converter means comprises a rejuvenatable catalytic converter cartridge, said cartridges aligned adjacent to each other in series.

3. The system of claim 2, further comprising sensor and control means for determining when said cartridges require rejuvenation.

4. The system of claim 3, further comprising cartridge information display means for displaying information related to the status of said cartridges to the driver of said vehicle.

5. The system of claim 4, further comprising starter disable means for disabling the starter system of said internal combustion engine responsive to said sensor and control means.

6. The system of claim 5, further comprising external display means for displaying warnings external to said vehicle, responsive to said sensor and control means, said warnings being perceptible to the human senses.

7. An improved contaminant removal assembly for removing undesirable particulate and chemical contaminants from the exhaust stream of an internal combustion engine, the assembly comprising:

particle filtration means for filtering particulates out of said exhaust stream;

gas converter means for removing chemical contaminants from said exhaust stream, said gas converter means aligned in parallel with said particle filtration means; and a lower hub assembly from which extends an actuating handle, said actuating handle configured to cooperate with said lower hub assembly, said particle filtration means and said gas purification means to alternatively lock said particle filtration means and said gas purification means into an in-service position and release said particle filtration means and said gas purification means to an out-of-service position.

8. The assembly of claim 7, wherein said lower housing assembly further comprises a cam plate for said cooperating with said actuating handle to alternatively achieving said in-service position and said out-of-service position.

9. The assembly of claim 8, further comprising an upper housing assembly, said upper housing assembly further comprising biasing means for biasing said particle filtration means and said gas converter means against said lower housing assembly.

10. The assembly of claim 9, wherein said particle filtration means comprises a rejuvenatable filter cartridge.

11. The assembly of claim 10, wherein said gas converter means comprises a rejuvenatable catalytic converter.

12. The assembly of claim 11, further comprising sensor means for determining when said particle filtration means and said gas converter means require rejuvenation.

13. The assembly of claim 12, further comprising starter disable means for disabling the starter system of said internal combustion engine responsive to said sensor means.

14. The assembly of claim 13, further comprising:

cartridge tracking indicia displayed on said particle filtration means and said gas purification means, said cartridge tracking indicia cooperating with a master electronic tracking system for maintaining records of the status and history of said particle filtration means and said gas converter means.

15. A method for removing undesirable particulate and chemical contaminants from the exhaust stream of an internal combustion engine, comprising the steps of:

passing said exhaust stream through a filter/purifier assembly, said assembly comprising a particle filter cartridge and a gas converter cartridge;

monitoring the performance of said cartridges;

generating an alert perceptible to the human senses responsive to said monitoring;

deactivating said cartridges;

replacing said cartridges responsive to said alert; and restoring said cartridges to service.

16. The method of claim 15, wherein said generating comprises:

generating a starter disable signal to disable the starter system of said vehicle; and generating an external alert signal.

17. The method of claim 16, wherein said deactivating comprises placing said cartridges in an out-of-service position.

18. The method of claim 17, further comprising the step of removing at least one said cartridge from said filter/purifier assembly.

19. The method of claim 18, further comprising a rejuvenation step after said removing step, said rejuvenation step comprising rejuvenating said cartridges for later restoration in service.

20. The method of claim 15, wherein said monitoring step further includes monitoring the duration that said cartridges have been in service.

* * * * *